United States Patent [19]

McArdle et al.

[11] Patent Number: 4,784,628

[45] Date of Patent: Nov. 15, 1988

[54] TOY BALLOON WITH IMPROVED SKIRT AND GONDOLA

[76] Inventors: Blaise L. McArdle, P.O. Box 994, Marblehead, Mass. 01945; Frederick E. Tillotson, R.R. 1, Dixville Notch, N.H. 03576

[21] Appl. No.: 12,923

[22] Filed: Feb. 10, 1987

[51] Int. Cl.[4] ..... A63H 27/10

[52] U.S. Cl. ..... 446/225; 446/222

[58] Field of Search ..... 446/225, 224, 222, 220, 446/221, 223

[56] References Cited

U.S. PATENT DOCUMENTS

| | | | |
|---|---|---|---|
| 344,515 | 6/1886 | Biehl | 446/225 |
| 673,776 | 5/1901 | Kavanagh . | |
| 1,077,735 | 11/1913 | Morinaga | 446/225 |
| 1,262,676 | 4/1918 | Kiriyama | 446/224 |
| 1,570,642 | 1/1926 | Reed | 446/224 |
| 4,145,838 | 3/1979 | Mason . | |
| 4,428,149 | 1/1984 | Brown | 446/222 |

FOREIGN PATENT DOCUMENTS

| | | | |
|---|---|---|---|
| 402983 | 10/1909 | France | 446/225 |
| 2093709 | 9/1982 | United Kingdom | 446/222 |

*Primary Examiner*—Mickey Yu

*Attorney, Agent, or Firm*—Jones, Askew & Lunsford

[57] ABSTRACT

The present invention provides an imitation lighter-than-air craft having an improved skirt and gondola. The skirt includes an attachment assembly to ensure that the skirt is snugly positioned against a conventional inflatable balloon, such that the skirt and balloon combine to imitate the envelope of a true lighter-than-air craft. Also provided is an improved gondola which utilizes elements similar or identical to those used in the skirt and attachment assemblies, resulting in savings in manufacturing costs in that a minimum number of different parts are required.

20 Claims, 4 Drawing Sheets

TOY BALLOON WITH IMPROVED SKIRT AND GONDOLA

TECHNICAL FIELD

The present invention relates to toys or decorative articles, and more particularly relates to an imitation hot-air balloon.

BACKGROUND OF THE INVENTION

Hot-air ballooning has long been known as a means of air transportation and recreation. These balloons usually include a spherically-shaped nylon envelope and an basket-shaped passenger gondola suspended below the envelope. When the envelope is inflated with hot air, it provides enough buoyancy to lift the gondola.

The means for heating air to fill the envelope through a lower opening is normally provided by a natural gas or propane burner, which is positioned outside and below the balloon envelope, but has its heat exhaust port directed upwardly toward an opening provided at the bottom of the envelope. A tubular skirt typically extends downwardly from the envelope opening, and provides a means for guiding the heated air from the burner to within the envelope.

The envelopes of these balloons may display bright colors and have a high degree of aesthetic appeal. It therefore has become desirable to provide a miniature imitation hot-air balloon for toy or display purposes, which likewise has an aesthetic appeal, but does not necessarily have to include a burner, which could be potentially dangerous especially if handled by children.

U.S. Pat. No. 1,427,396 to Keith discloses a toy air ship including an elongated type balloon having various attachments including end cones and a car. United Kingdom Pat. No. 6512 to Waegemann discloses a childrens' balloon in the form of a "zeppelin"-type air ship including a cigar-shaped rubber tube surrounded by thin tissue from which various fins extend. French Pat. No. 402,983 to Mondy discloses an imitation air ship including a spherically-shaped balloon from which a gondola is suspended.

The applicants' U.S. Patent Application No. 06/858,686, hereby incorporated by reference, discloses an imitation lighter-than-air craft including an exterior envelope, a gas bag situated within the exterior envelope, and a gondola suspended below the exterior envelope and the gas bag.

Although the above-mentioned devices do simulate hot-air balloons, it may be seen that some of these devices tend to be relatively complex, and require an investment in materials and assembly time. Therefore it is desirable to provide an imitation hot-air balloon which closely simulates a true hot-air balloon, yet is simple in construction and easily assembled.

SUMMARY OF THE INVENTION

The present invention solves the above described problems in the prior art by providing an improved imitation hot air balloon. An imitation hot air balloon according to the present invention includes a conventional inflatable balloon, and also includes an imitation skirt which is secured to the neck of the balloon, and conceals the neck from normal view.

Generally described, the imitation lighter-than-air craft according to the present invention includes an inflatable balloon having a inlet valve, the inlet valve including an outwardly disposed neck, a locking disc attached to the neck, a tubular skirt having a longitudinal bore, the locking disc positioned within said bore, and means for securing said disc within said bore such that said skirt is secured to said balloon.

Thus, it is an object of the present invention to provide an improved imitation hot air balloon assembly.

It is a further object of the present invention to provide an imitation hot air balloon assembly which is aesthetically pleasing.

It is a further object of the present invention to provide an imitation hot air balloon assembly which is inexpensive and is simple to assemble.

It is a further object of the present invention to provide an imitation hot air balloon assembly with buoyant properties.

Other objects, features and advantages of the present invention will become apparent from reading the following specification when taken in conjunction with the accompanying drawings.

DETAILED DESCRIPTION

Figure 1:
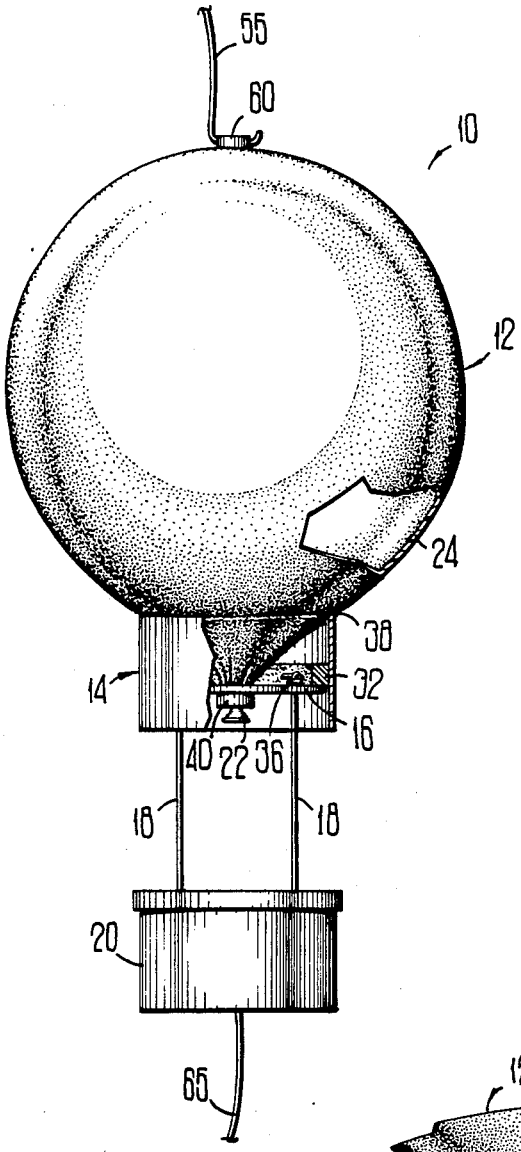
FIG. 1 is a side plan view of an imitation hot air balloon assembly according to a first preferred embodiment of the present invention, showing the skirt of the balloon assembly in partial cutaway.

Referring now in more detail to the drawings, in which like numerals indicate like parts throughout these several views, FIG. 1 shows an imitation hot-air balloon assembly noted generally at 10 which includes a balloon 12, a skirt 14, a locking ring 32, a locking disc 16, gondola suspension cords 18, and a gondola 20.

Referring now generally to FIGS. 2–5, the balloon 12 is capable of containing air or gas and includes a mouth 22 through which such air or gas may be introduced or exhausted. The balloon 12 also includes walls 24, and a neck 52 (see FIG. 2).

Figure 5:
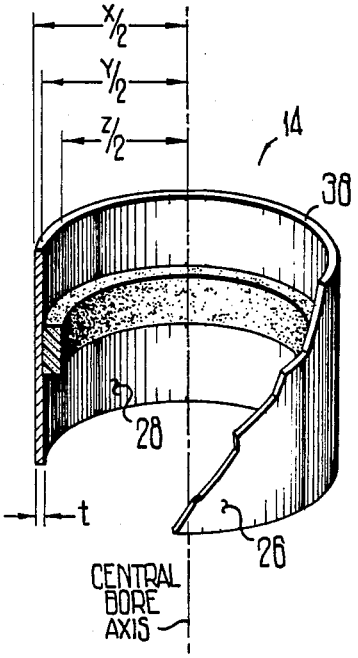
FIG. 5 is an isolated pictorial view of the skirt of the balloon assembly of FIG. 1, shown in partial cutaway to expose the locking ring.

The skirt 14 is cylindrical in shape, and has an circular outer transverse cross section of diameter X (see FIG. 5) and a circular bore cross section of diameter Y (also see FIG. 5). The skirt 14 includes an outer wall surface 26, an inner wall surface 28, an upper ridge 38, and a wall of thickness t (See FIG. 5).

Within the bore of the skirt 14 is mounted a locking ring 32 rigidly attached to the interior wall 28 of the skirt by gluing or other suitable means. Referring now only to FIG. 5, the locking ring 32 has a circular outer diameter of length Y, and a circular inner diameter of length Z. As will be discussed later in this application, the locking ring 32 provides an annular shoulder within the bore of the skirt 14 which prevents the locking disc 16 from passing through the bore of the skirt 14 when the skirt and the ring are in nondeformed states, and the primary planar surfaces of the disc are normal to the bore axis of the skirt.

The locking disc 16 is planar and defines a center hole 34 (see FIG. 2) and four suspension cord holes (not shown) spaced about the outer perimeter of the disc. The locking disc 16 has a circular outer perimeter, the diameter of which is less than the inner diameter Y of the skirt, but greater than the inner diameter Z of the locking ring.

Gondola suspension cords 18 pass through the suspension cord holes defined by the locking disc 16. The upper end of each of the gondola suspension cords 18 is knotted at 36, such that the upper ends of the gondola suspension cords 18 may not pass through the corresponding holes in locking disc 16. A gondola 20 is suspended beneath the locking disc 16 by the gondola suspension cords 18.

Figure 2:
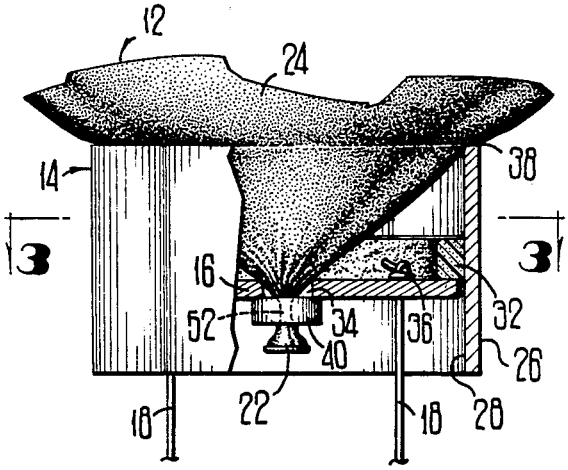
FIG. 2 is a close-up view of the skirt of the balloon assembly as shown in FIG. 1.

To assemble the device, the gondola suspension cords 18 are passed through the suspension cord holes in locking disc 16, and the upper ends are knotted at 36. The lower ends of the gondola suspension cords 18 are attached to the gondola 20 in a conventional manner in the embodiment shown in FIG. 1. Air or gas, whichever is preferred, is introduced into the mouth 22 of the balloon 12 until the balloon 12 reaches a desired size. The mouth 22 is then passed through the hole 34 in the locking disc 16 and a conventional clip 40 is attached to the neck 52 of the mouth 22. It should be understood that the clip 40 is of sufficient size such that it will not pass through the center hole of the locking disc 16. As shown in FIG. 2, it may be necessary to twist the neck 52 of the balloon prior to attaching the clip 40, to insure that air or gas does not escape.

Figure 4:
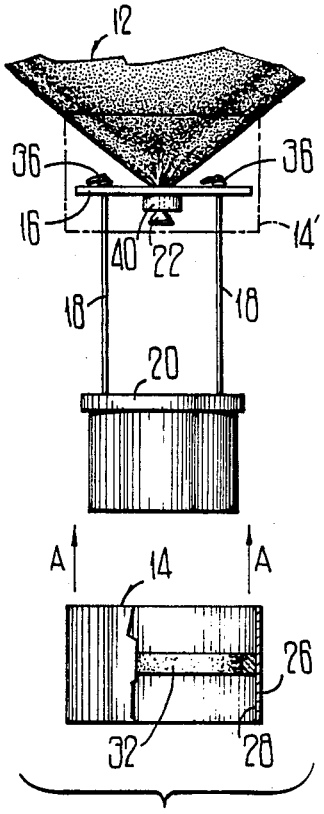
FIG. 4 is a close-up, partially exploded view of the balloon assembly of FIG. 1, with the gondola in partial cutaway and separated from the assembly. The assembled position of the gondola is indicated in phantom.

When the clip 40 is in place, the resulting assembly is as shown in FIG. 4. The skirt 14 is then moved in a direction as shown by arrows A in FIG. 4 toward an end position as shown in 14' such that the skirt conceals the locking ring.

As the locking ring 32 encounters the locking disc 16, it should be understood that either the locking disc 16 or the skirt 14 (and the attached locking ring 32) must be slightly deformed in order to allow the locking disc 16 to pass through the locking ring 32.

If it is desired to deform the locking disc 16 to allow the locking disc to pass through the locking ring 32, the locking disc 16 may be folded and tilted somewhat relative to the locking ring to allow the locking disc to pass through the locking ring. If it is desired to deform the skirt 14 and attached locking ring 32, the locking ring 32 may be deformed by pressing inwardly on opposite sides of the skirt such that the skirt and locking ring assume an oval configuration, and the locking ring may be tilted and passed through the bore of the locking ring 32. As discussed later, in the preferred embodiment these elements are readily deformable as they are made of conventional paperboard, although alternate materials such as plastics may be readily substituted.

It should be understood that both the locking disc 16, the skirt 20, and the locking ring 32 may all be simultaneously deformed during assembly as described above if desired. It should also be understood that the configuration of the balloon 12, the locking disc 16, the skirt 14, and the locking ring 32 is such that the neck 52 of the balloon is slightly stretched as the disc is drawn through the bore of the skirt and the locking ring.

Figure 3:
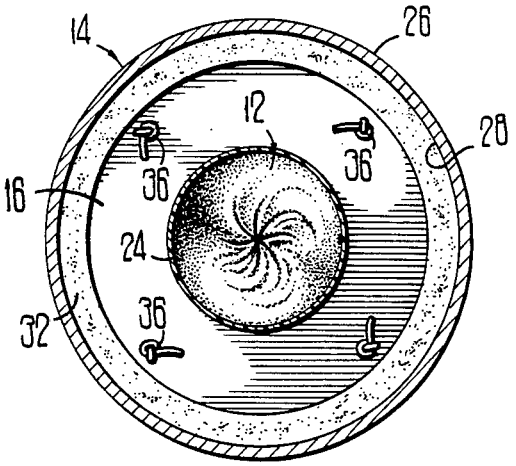
FIG. 3 is a cutaway view of the balloon assembly of FIG. 1 along line 3—3, as viewed from above.

After the locking disc 16 passes through the locking ring 32, the locking disc, the locking ring 32, and the skirt 14 are all allowed to assume undeformed configurations. The locking ring is then released and the tension from the neck 52 of the balloon 12 seats the locking disc 16 against a shoulder provided by the lower planar surface of the locking ring, thus allowing the skirt 14 to assume an assembled position as shown in FIGS. 1, 2, and 3.

When the skirt 14 is in its assembled position, it should be understood that the upward force exerted upon the locking disc 16 is transferred through the locking disc 16 to the skirt 14, such that the upper edge 38 of the skirt fits snugly against the outside surface of the balloon 12. This is advantageous in that the mouth 22 of the balloon is concealed by the skirt 14, yet the skirt 14 fits snugly against the lower end of the balloon, providing a realistic imitation of a true hot air balloon, in which the envelope and the gondola are normally integrally joined by a sew line.

Figure 6:
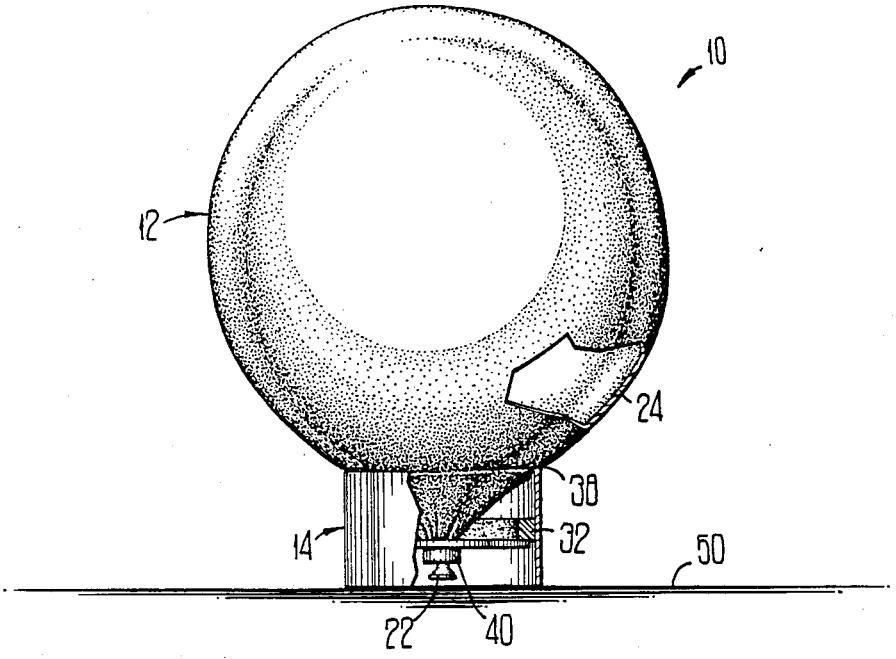
FIG. 6 is a second embodiment of the present invention, positioned atop a supporting surface.

Other embodiments of the invention are shown in FIGS. 6, 7, 8, 9 and 10. FIG. 6 shows the configuration of FIG. 1 without gondola suspension cords or a gondola. This configuration may be placed upon a typical supporting surface 50.

Figure 7:
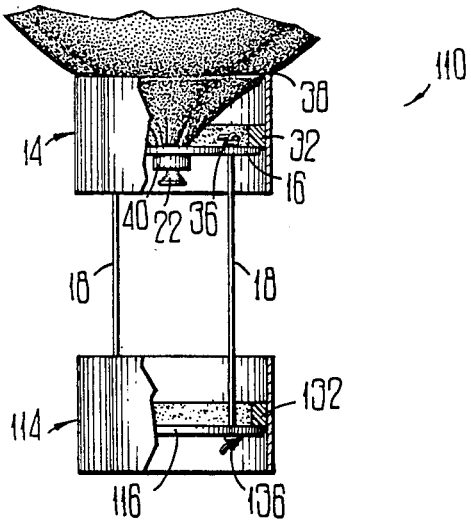
FIG. 7 is a third embodiment of the present invention, which includes an alternative gondola configuration, the skirt and gondola being shown in partial cutaway for purposes of illustration.

FIG. 7 shows an alternate gondola assembly 110 which utilizes elements similar to the skirt 14, the locking disc 16, and the locking ring 32. Gondola shell 114 is similar to the skirt 14. Gondola locking floor 116 is similar in shape to the locking disc 16. Gondola locking ring 132 is similar in configuration to locking ring 32. Likewise, the cooperating relationship between elements 114, 116, and 132 is similar to the cooperation between elements 14, 16, and 32. Finally, the assembly of elements 114, 116, and 132 is similar to the assembly of elements 14, 16, and 32, as previously discussed, except that of course a balloon is not attached to the gondola locking floor 116. The gondola assembly 110 is suspended by the suspension cords 18 which are knotted at their lower ends at 136.

The configuration of gondola assembly 110 is advantageous in that the same of similar parts used in the other parts of the balloon assembly may be used to construct the gondola assembly. This results in savings in manufacturing costs in that a minimum amount of different parts are required.

Figure 8:
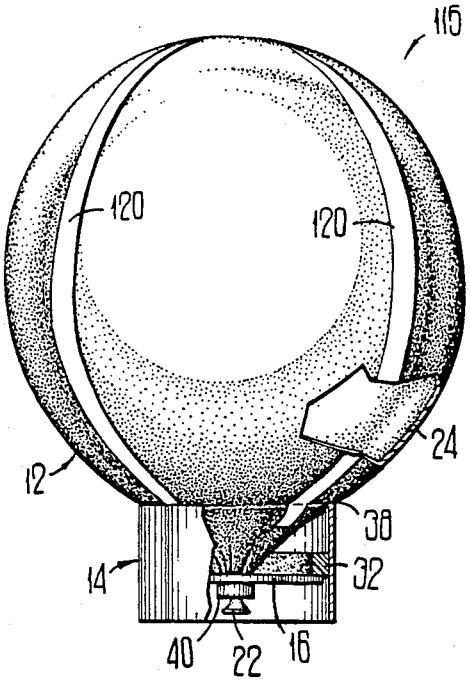
FIG. 8 is a forth embodiment of the present invention, which includes the use of decorative ribbons.
Figure 9:
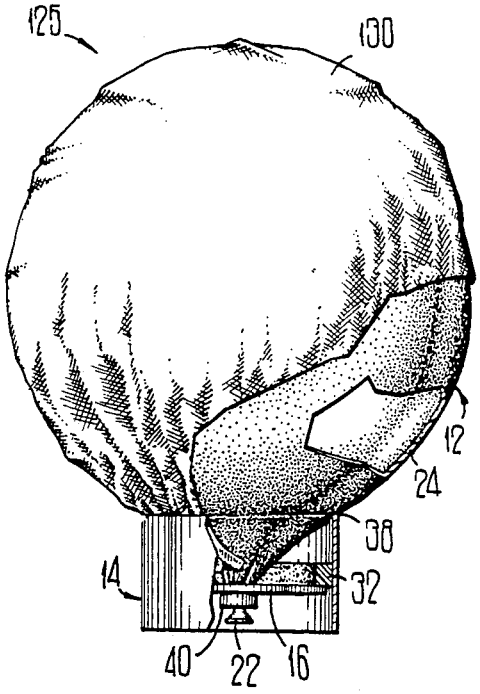
FIG. 9 is a fifth embodiment of the present invention, which includes the use of a tissue-type paper covering the balloon.

As shown in FIGS. 8 and 9, the snug fit between the skirt 14 and the balloon 12 may be used to another advantage in that decorative articles may be readily attached to the balloon assembly 10 by lodging one portion of the decorative article between the skirt and the balloon. As shown in FIG. 8, ribbons 120 may be passed over the balloon 12 and have ends secured to opposite sides of the balloon assembly 115 between the skirt 14 and the balloon. As shown in FIG. 9, the balloon assembly 125 includes a decorative sheet of tissue paper 130 or the like placed over the entire balloon and "bunched" underneath the skirt 14 such that the balloon 12 is completely concealed, and the tissue simulates an actual balloon envelope even more effectively than would the balloon. It should be understood that in this configuration, the tissue paper is held in place between the skirt 14 and the balloon 12.

Referring now to FIG. 1, as previously discussed, the balloon 12 may be filled with air, or a gas, including a lighter-than-air gas. Should the balloon 12 be filled with air, it should be understood that the assembly 10 will be heavier than air. Therefore an assembly suspension cord 55 may be attached to the top of the balloon 12 by an adhesive element 60 or other suitable means to allow the assembly 10 to be suspended from above. If it is desired to fill the balloon 12 with a lighter-than-air gas such as helium, it should be understood that by using suitably light materials for the assembly 10, and by introducing a suitable amount of lighter-than-air gas within the balloon 12, the resulting assembly may be lighter than air. A tethering cord 65 may be used to tether such a lighter-than-air craft from below.

It should be understood that when the balloon assembly is fully assembled, the configuration of the balloon 12 could be such that the upper edge 38 does not fit snugly against the balloon, and therefore, there is not a snug fit between the skirt 14 and the balloon 12. In this event, the mouth 22 of the balloon 12 could be pulled further through the hole 34 in the skirt 16, and the clip 40 could be moved further along the neck 52 of the mouth of the balloon, until the skirt 14 fits snugly against the balloon 12.

The balloon 12 of the preferred embodiment is conventional and composed of latex rubber, which may be marked with indicia on its exterior surface. Although the material of the balloon 12 in the preferred embodiment is stretchable, this is not critical. For example, a metallic or foil-type balloon could also be used. However, it should be understood that the use of such a non-stretchable material would increase the probability that the previously discussed clip adjustment along the neck of the balloon would need to be performed.

The skirt 14 of the preferred embodiment is composed of paperboard which may be marked with indicia by conventional printing processes known in the art such as photocopying. However, other lightweight material such as plastic or thin sheet metal may also be used. The material used in the skirt 14 is not critical, although it should be able to withstand the slight compressive force which is exerted by the balloon as previously discussed. Also, should it be desired to deform the skirt 14 to allow the locking disc 16 to pass the locking ring 32, a suitably flexible material should be used.

The locking disc 16 is composed of paperboard, although other lightweight material such as plastic or thin sheet metal may also be used. Should it be desired to deform the skirt 14 to allow the locking disc 16 to pass the locking ring 32, a suitably flexible material should be used.

The locking ring 32 is composed of low-density polyethylene foam, although other materials may be used. For example, such a rim may be provided by "layering" a plurality of paper strips within the skirt 14. Also, plastic or wood may be used. As discussed in material requirements for the skirt 14, should it be desired to deform the locking ring 32 to allow the locking disc to pass through the locking ring, the locking ring should be made of a suitably flexible material.

The gondola suspension cords 18, the assembly suspension cord 55, and the tethering cord 65 may be made of conventional hemp, wire, or synthetic material such as a plastic. The material construction of these cords is not critical, except that the material should be able to withstand a tension force.

The gondola 20 may be composed of paperboard, plastic, straw, or even metal.

Of course, the selection of materials may depend on whether it is desired to construct a lighter-than-air craft. If such is an not an objective, weight considerations of material is not as important.

The clip 40 is conventional. The particular clip used in the preferred embodiment is a nylon clip which may be clipped around the neck 52 of the balloon.

It should be understood that it is not critical that a clip be used around the neck 52 of the balloon 12, as it could be possible to provide a knot in the neck which is sufficient in size to prevent the mouth 22 from passing through the hole 34. It is only desirable that the mouth be sealed, and that it is not able to pass through the hole 34 in the locking disc 16.

From the detailed description above, other embodiments of the present invention will be suggested to those skilled in the art. For example, it is not necessary that the balloon 12 be spherical, as the present invention also contemplates the use of a elongate, "dirigible-shaped" balloon.

It is also not necessary that the locking ring 32 be continuous around the inside surface 28 of the skirt 14. The locking ring 32 could include one or more gaps, or may even be reduced to a series of tabs extending inwardly from the skirt, which combine to prevent the locking disc from passing through the skirt as previously discussed.

It is also not critical that the skirt be cylindrical, or that the locking ring be circular. For example, it could be possible to provide a square or rectangular skirt, and an accompanying square or rectangular locking disc substitute.

Figure 10:
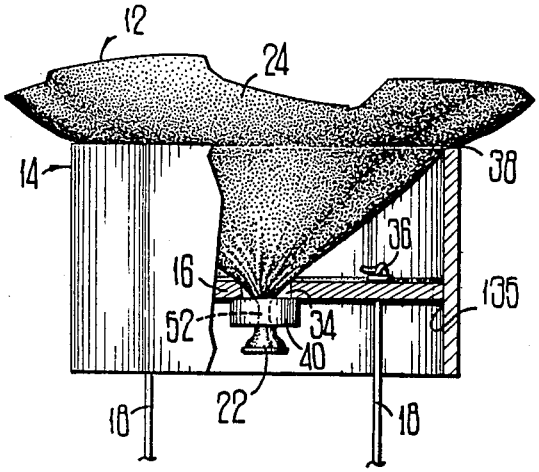
FIG. 10 is a sixth embodiment of the present invention, showing the integral nature of the skirt and locking disc.

Finally, some of the elements used in the preferred embodiments may be eliminated while still remaining within the spirit and scope of the present invention. FIG. 10 shows an alternative means of attaching the locking disc 16 to the skirt 14, the use of adhesive 135. It should be understood that a different method of assembly will be required than previously described should this configuration be used. To attach the balloon 12 to the locking disc 16 in FIG. 10, the balloon is first inflated, and than the neck of the balloon is passed into the bore of the skirt and then drawn through the hole in the locking disc. The mouth 22 of the balloon 12 is then sealed as previously described. Although this assembly method may be somewhat more awkward than the previously-discussed assembly method, savings are made in material costs as there is no need for a locking ring. It should also be understood that this locking disc-skirt combination could also be fabricated out of an integral piece of material such as a plastic, for further cost savings.

As previously discussed, different types of materials may also be substituted for materials used in the preferred embodiment. Accordingly, the scope of this invention is to be limited only by the claims below.

What is claimed is:

1. An imitation lighter-than-air craft, comprising:

an inflatable balloon having a inlet valve, said inlet valve including an outwardly disposed neck;

a locking disc attached to said neck;

a tubular skirt separate from said disc having a longitudinal bore defined by an inner wall, said locking disc positioned within said bore; and means for detachably securing said disc to said skirt within said bore at a position along said bore such that said skirt is biased against said balloon.

2. The imitation lighter-than-air craft of claim 1, wherein said locking disc defines a hole, and wherein said locking disc is attached to said neck by passing said neck through said hole, and attaching a clip to said neck, said neck being of size sufficient to prevent said clip from passing through said hole.

3. The imitation lighter-than-air craft of claim 1, wherein said locking disc defines a hole, and wherein said locking disc is attached to said neck by passing said neck through said hole, and tying a knot in said neck such that said knot is of size sufficient to prevent said neck from passing out of said hole.

4. An imitation lighter-than-air craft, comprising:

an inflatable balloon having a inlet valve, said inlet valve including an outwardly disposed neck;

a locking disc attached to said neck;

a tubular skirt separate from said disc having a longitudinal bore defined by an inner wall, said locking disc positioned within said bore of said tubular skirt;

means for detachably securing said disc to said skirt within said bore at a position along said bore such that said neck of said balloon is in tension and said skirt is biased against said balloon; and a gondola assembly, comprising:

a tubular shell having a longitudinal bore;

a locking floor disc positioned within said longitudinal bore of said tubular shell;

means for attaching said locking floor disc to said shell; and a gondola suspension cord having an upper and a lower end, said upper end attached to said locking disc, and said lower end attached to said locking floor of said gondola assembly, such that said gondola assembly is suspended below said inflatable balloon.

5. The imitation lighter-than-air craft of claim 1, wherein said skirt defines an inner wall surface, and wherein said means for detachably securing said disc to said skirt comprises a shoulder attached to and extending inwardly from said inner wall surface, said shoulder configured to prevent passage of said disc through said skirt when said disc and said skirt are in nondeformed configurations.

6. The imitation lighter-than-air craft of claim 5, wherein said shoulder is a ring extending substantially continuously around said inner wall surface, wherein said ring may be deformed to allow said disc to pass therebetween, and wherein said disc may not pass through said ring when said ring and said disc are in nondeformed configurations.

7. The imitation lighter-than-air craft of claim 5, wherein said shoulder is a ring extending substantially continuously around said inner wall surface, wherein said disc may be deformed to allow said disc to pass though said ring, and wherein said disc may not pass through said ring when said ring and said disc are in nondeformed configurations.

8. A method of assembling an imitation lighter-than-air craft, comprising the steps of:

(a) inserting a disc into a first open end of a tubular skirt having a longitudinal bore and an inner wall, said disc being attached to the neck of a balloon;

(b) transferring said disc toward along the longitudinal bore of said skirt until said disc passes a shoulder extending inwardly from said inner wall of said skirt;

(c) releasing said disc such that said disc is prevented by said shoulder from passing back through said first open end of said skirt.

9. A method of assembling an imitation lighter-than-air craft, comprising the steps of:

(a) inserting a disc into the first open end of a tubular skirt, said disc being attached to the closed neck of an inflated balloon, and said tubular skirt having a longitudinal bore, an inner wall, a second end opposite said first end, and a shoulder intermediate said first and second ends extending inwardly from said inner wall into the bore of said skirt;

(b) manipulating said disc relative to said skirt while transferring said disc substantially along the longitudinal axis of said skirt until said disc passes said shoulder; and (c) releasing said disc and said skirt such that said disc is prevented by said shoulder from passing back through said first open end of said balloon.

10. The method of assembling an imitation lighter-than-air craft as claimed in claim 9, wherein in step "b", said neck of said balloon is in tension when said disc passes said shoulder, and wherein in step "c", said tension of said neck biases said disc against said shoulder.

11. A method of assembling an imitation lighter-than-air craft, comprising the steps of:

(a) attaching a disc to the closed neck of an inflated balloon;

(b) inserting said disc into a first end of a tubular skirt, said tubular skirt having a longitudinal bore, an inner wall, a second end opposite said first end, and a shoulder intermediate said first and second ends extending inwardly from said inner wall into the bore of said skirt;

(c) manipulating said disc relative to said skirt while transferring said disc substantially along the longitudinal axis of said skirt until said disc passes said shoulder; and (d) releasing said disc and said skirt such that said disc is prevented by said shoulder from passing back through said first open end of said balloon.

12. The method of assembling an imitation lighter-than-air craft as claimed in claim 11, wherein in step "c", said neck of said balloon is in tension when said disc passes said shoulder, and wherein in step "d", said tension of said neck biases said disc against said shoulder.

13. A method of assembling an imitation lighter-than-air craft, comprising the steps of:

(a) attaching a disc to the closed neck of an inflated balloon, said balloon having an outer surface adjacent to and about said neck;

(b) inserting said disc into a first end of a tubular skirt, said tubular skirt having a longitudinal bore, an inner wall, a second end opposite said first end, and a shoulder intermediate said first and second ends extending inwardly from said inner wall into the bore of said skirt;

(c) manipulating said disc relative to said skirt while transferring said disc substantially along the longitudinal axis of said skirt against the tension of said neck until said disc passes said shoulder;

(d) releasing said disc and said skirt such that said disc is drawn back by the tensile force of said balloon neck such that said disc is biased against said shoulder, and said skirt is biased against said outer surface of said balloon.

14. The method as claimed in claim 13, wherein said shoulder is a continuous annular shoulder ring extending substantially continuously around said inner wall surface, and wherein in step "c", said disc passes through said ring.

15. The method as claimed in claim 14, wherein in step "c" said ring is deformed to allow said disc to pass through said ring, and wherein said disc may not pass through said ring when said ring and said disc are in nondeformed configurations.

16. The method as claimed in claim 14, wherein in step "c" said ring is radially deformed to from an oval shape such that said disc may be tilted and pass sideways through said ring.

17. The method as claimed in claim 14, wherein in step "c" said disc is deformed to allow said disc to pass though said ring, and wherein said disc may not pass through said ring when said ring and said disc are in nondeformed configurations.

18. The method as claimed in claim 17, wherein in step "c" said disc is folded from a generally planar shape and tilted to allow it to pass sideways through said ring.

19. The method as claimed in claim 18, wherein in step "c" said ring is also deformed to allow said disc to pass though said ring, and wherein said disc may not pass through said ring when said ring and said disc are in nondeformed configurations.

20. The method as claimed in claim 19, wherein in step "c", said ring is radially deformed to an oval shape and said disc is folded from a generally planar shape such that said disc may be tilted and pass sideways through said ring.

* * * * *